United States Patent [19]

Suzuki et al.

[11] Patent Number: 4,958,104

[45] Date of Patent: Sep. 18, 1990

[54] DISPLAY DEVICE HAVING FIRST AND SECOND COLD CATHODES

[75] Inventors: Hidetoshi Suzuki; Mitsuru Yamamoto, both of Atsugi; Toshiaki Majima, Tokyo; Ichiro Nomura, Yamato, all of Japan

[73] Assignee: Canon Kabushiki Kaisha, Tokyo, Japan

[21] Appl. No.: 373,636

[22] Filed: Jun. 29, 1989

Related U.S. Application Data

[63] Continuation of Ser. No. 86,804, Aug. 19, 1987, abandoned.

[30] Foreign Application Priority Data

Aug. 20, 1986 [JP] Japan ..... 61-192817
Aug. 20, 1986 [JP] Japan ..... 61-192818
Aug. 20, 1986 [JP] Japan ..... 61-192819

[51] Int. Cl.[5] ..... H01J 31/48; H01J 29/70

[52] U.S. Cl. ..... 313/495; 313/391; 313/422

[58] Field of Search ..... 313/495, 395, 397, 422, 313/491

[56] References Cited

U.S. PATENT DOCUMENTS 4,259,678 3/1981 van Gorkom et al. ..... 357/13
4,303,930 12/1981 van Gorkom et al. ..... 357/13
4,325,084 4/1982 van Gorkom et al. ..... 313/391 X

FOREIGN PATENT DOCUMENTS 54-111272 8/1979 Japan .
54-30274 9/1979 Japan .
56-15529 2/1981 Japan .
57-38528 3/1982 Japan .

OTHER PUBLICATIONS

"Flat-Panel Displays and CRT's" by L. E. Tannas, Jr.; Van Nostrand Reinhold Co., Inc., N.Y. 1985, pp. 213–216.

*Primary Examiner*—Donald J. Yusko
*Attorney, Agent, or Firm*—Fitzpartick, Cella, Harper & Scinto

[57] ABSTRACT

A display device has an electron ray generating unit of matrix electrode structure in which a plurality of cold cathodes generating electron rays are arranged two-dimensionally, image storing apparatus for storing therein image information as an amount of charges by a variation in a surface potential produced by the application of the electron rays from the electron ray generating unit, and a display for receiving the application of the electron rays applied from the electron ray generating unit and modulated by the electric charge stored in the image storing apparatus and visualizing the image information.

10 Claims, 7 Drawing Sheets

DISPLAY DEVICE HAVING FIRST AND SECOND COLD CATHODES

This application is a continuation of application Ser. No. 086,804 filed Aug. 19, 1987, now abandoned.

BACKGROUND OF THE INVENTION

1. Field of the Invention

This invention relates to a display device in a storage type image display device using a solid electron beam generating apparatus, and a display device in an electron ray generating apparatus using the solid electron beam generating apparatus.

2. Related Background Art

In recent years, the rapid advancement of image processing technique has increased the demand for devices for displaying images of great capacity. As a device for displaying such images of great capacity, there is known, for example, a storage type display device as shown in FIG. 5 of the accompanying drawings. In FIG. 5, reference numeral 11 designates a writing gun, and reference numeral 12 denotes a deflecting electrode. An electron ray emitted from the writing gun 11 is deflected by the deflecting electrode 12 in conformity with image information and arrives at a storage plate 15. The storage plate 15 comprises a thin film of a dielectric material formed on the surface of a fine metal mesh, and discharges secondary electrons and is charged positive when the electron ray impinges thereon. The amount of charges stored by charging corresponds to the image information. That is, the image information is preserved as an amount of positive charges. When this image information is to be displayed on a fluorescent screen 16, an electron ray is emitted from a flood electron gun 17 and applied to the whole surface of the storage plate 15 by a collimator lens 14. This electron ray passes through that portion of the storage plate 15 which has been positively charged, and is intercepted by the other portions. The electron ray having passed through this positively charged portion impinges on the fluorescent screen 16 and thus, the fluorescent material applied to the inside surface of the screen emits light. In FIG. 5, reference numeral 13 designates a collector electrode for catching the secondary electrons from the storage plate 15 and providing a return path.

In such a storage type display tube, however, it is necessary to provide discrete electronic optical systems in the writing electron gun and the applying electron gun, respectively, and this has led to the structural complexity and bulkiness of the tube, which has also led to a high manufacturing cost.

Also, the flood electron gun 17 is designed to apply an electron ray to the whole surface of the storage plate 15 and therefore partial erasing is not possible, and this has led to the inconvenience that even when only a part of the displayed image is to be rewritten, the whole screen must be once erased.

On the other hand, for example, in the fields of recording and electron ray lithography, various devices have heretofore been proposed as applications of electron ray lithography. However, these devices use chiefly hot cathodes as electron ray sources. The hot cathodes used in these devices utilize the hot electron emission by heating and therefore have suffered from the disadvantage that they require high power consumption and moreover a certain degree of pre-heating time and cannot be immediately operated when the power source is switched on. Also, where image display is effected by the use of an electron ray, to achieve a great capacity and a high speed it will be advantageous to dispose a plurality of electron ray sources, but it has been difficult to arrange conventional hot cathodes of uniform characteristics with high positional accuracy.

SUMMARY OF THE INVENTION

The present invention has been made in view of the above-described prior art and an object thereof is to provide an image display device which does not require a complicated electronic optical system and which is capable of partial erasing.

A further object of the present invention is to eliminate the above-noted disadvantages peculiar to the prior art and to provide a display device having a feature of electron ray generation which results in the simplification of the surrounding circuit.

This specification and the accompanying drawings disclose, in a storage type image display device using a solid electron beam generating apparatus, the technique of constructing an electron ray generating unit of matrix electrode structure in which a plurality of solid electron beam generating apparatuses are arranged two-dimensionally, thereby eliminating any complicated electronic optical system and enabling partial erasing. Also, the specification and the drawings disclose a display device which enables partial erasing to be accomplished by the electron ray generating unit being made into a matrix electrode structure in which at least two kinds of plural solid electron beam generating apparatuses differing in electron ray emission characteristic are arranged two dimensionally, and which is very useful in practice.

Further, the specification and the drawings disclose, in electron ray generation, the technique of two-dimensionally arranging a plurality of cold cathodes differing in emission characteristics to thereby make a matrix electrode structure, and selectively connecting the driving signal lines thereof to thereby facilitate the drive control thereof and achieve the simplification of the surrounding circuit.

DESCRIPTION OF THE PREFERRED EMBODIMENT

When an electron ray is applied from each cold cathode of an electron ray generating unit, image information is stored as charges in image storing means. When an electron ray is again applied from the electron ray generating unit to the stored charges, electrons pass through the positively charged portion and are intercepted by the other portions by a repulsion force. The electrons having passed through the image storing means in this manner are displayed as an image by visualizing means. Also, in the present invention, each minute cold cathode can be independently driven by a matrix electrode structure and therefore is capable of partial rewriting.

In the present invention, as the minute cold electrode generating the electron ray, use may be of a solid electron beam generating apparatus disclosed, for example, in Japanese Patent Publication No. 30274/1979, Japanese Laid-Open Patent Application No. 111272/1979 (U.S. Pat. No. 4,259,678), Japanese Laid-Open Patent Application No. 15529/1981 (U.S. Pat. No. 4,303,930) or Japanese Laid-Open Patent Application No. 38528/1982. This solid electron beam generating apparatus has a quick response speed and moreover can have its emitting surface made minute, and a plurality of such apparatuses can be two-dimensionally arranged with high positional accuracy by being formed by the process of photolithography or electron ray lithography. Further, cold cathodes different in radiation characteristic can also be formed on the same substrate.

Figure 1:
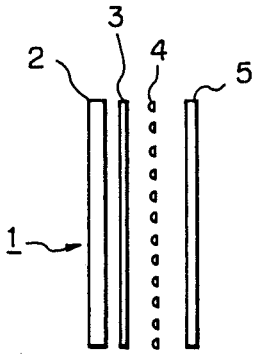
FIG. 1 shows the basic construction of a storage-type image display device according to the present invention.

FIG. 1 shows the basic construction of a storage-type image display device according to the present invention. In FIG. 1, the image display device 1 is comprised of an electron ray generating unit 2 in which a plurality of minute cold cathodes are two-dimensionally arranged, a collector electrode 3, a storage plate 4 and a target 5 which provides a display surface.

Figure 2:
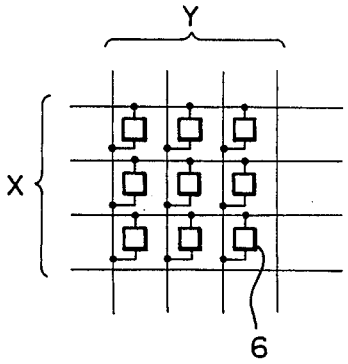
FIG. 2 is a schematic view of a matrix electrode.
Figure 3:
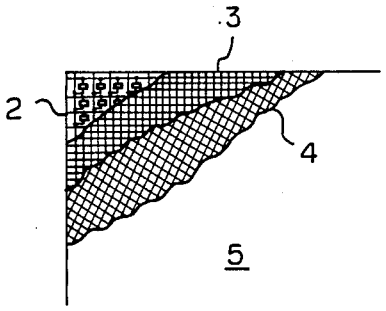
FIG. 3 is a partly cut-away view of the display device.

The electron ray generating unit 2, as shown in FIG. 2, comprises the minute cold cathodes 6 of the aforementioned solid electron beam generating apparatus connected together by an X—Y matrix electrode structure, and the minute cold cathodes 6 can be driven individually or simultaneously. The collector electrode 3, as previously described, is for catching secondary electrons and providing a return path, and may be, for example, a metal mesh of the order of 100–1000 lines/inch with nickel as a blank. The storage plate 4 may be, for example, an electrically conductive metal (nickel or the like) mesh of the order of 100–1000 lines/inch having produced on the surface thereof a thin film formed of a dielectric electron emitting material (magnesium fluoride, or magnesium oxide formed on calcium fluoride) of the order of 1–5 μm by the use of the vacuum production technique. The target 5 may be, for example, a transparent glass substrate having fine particles of a fluorescent material applied thereon, and further having an electrically conductive thin film of a metal formed thereon by vapor deposition. By adopting the construction of the present invention shown in FIG. 1, that is, by the use of an electron ray generating unit for storing the image information and the electron ray generating unit for visualizing the image information being formed on the same surface, the device can be made compact as compared with the conventional device and further, the space between the electron ray generating unit 2 and the storage plate 4 can be narrowed, specifically, to the order of 1 cm or several millimeters. In that case, the collector electrode 3 may be formed in proximity to the storage plate 4. FIG. 3 is a partly cut-away view of the display device according to the present invention as seen from the target 5 side.

A description will now be provided of the operations of the display device having the above-described construction.

Figure 4:
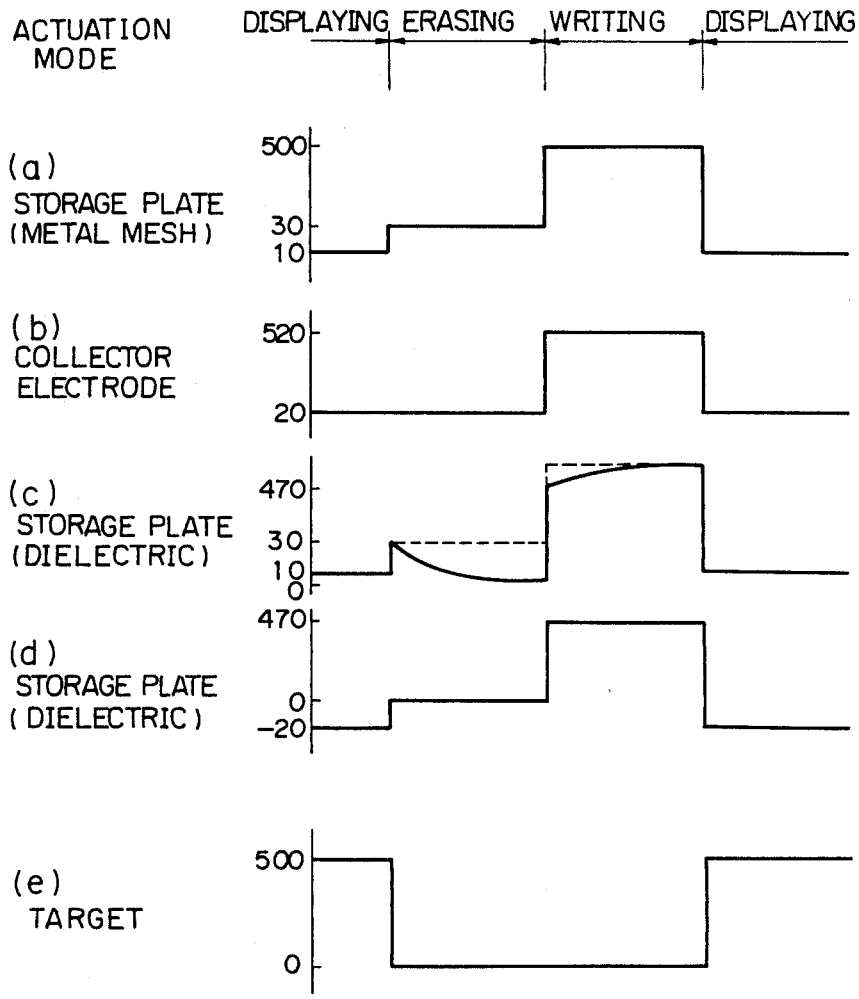
FIG. 4 shows the voltage waveforms of driving voltages.
Figure 5:
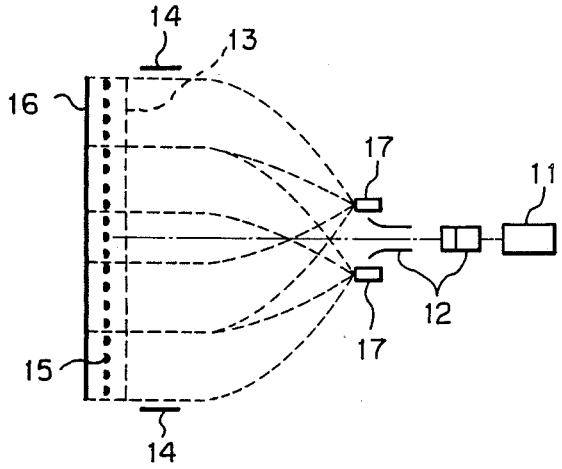
Fig. 5 PRIOR ART
FIG. 5 is a schematic view of a device according to the prior art.

FIG. 4 is a voltage waveform graph showing various driving voltage. In FIG. 4, the abscissa represents time and the ordinate represents the relative potential with the electron ray generating unit 2 as the reference. FIGS. 4(*a*)–(*e*) show the transitions of the potentials of various portions when three actuation modes of erasing, writing and displaying have been successively effected. That is, FIG. 4(*a*) shows the voltage applied to the electrically conductive metal mesh of the storage plate 4, FIG. 4(*b*) shows the voltage appled to the collector electrode 3, FIGS. 4(*c*) and (*d*) show the potentials of the dielectric layer on the surface of the storage plate 4, and in FIG. 4(*c*), the solid line represents a case where the image stored in advance is once erased in the erasing mode, whereafter writing is effected in the writing mode, and the broken line represents a case where the image stored in advance is not erased but is again displayed. FIG. 4(*d*) represents a case where there is no image stored in advance and neither erasing nor writing is effected. FIG. 4(*e*) represents the voltage applied to the electrically conductive thin film of the target 5. In the display device of the present invention, partial erasing of the stored image is possible and therefore, in a region where erasing is effected during the period of the erasing mode, the potential of FIG. 4(*c*) appears on the storage plate 4, and in a region where erasing is not effected during the period of the erasing mode, the potential of FIG. 4(*d*) appears on the storage plate 4.

The actuation for each mode will hereinafter be described in conjunction with FIG. 4. First, in the erasing mode, a voltage of the order of 30 V relative to the potential of the electron ray generating unit is applied to the electrically conductive metal plate which is the substrate of the storage plate 4. Substantially simultaneously therewith, the cold cathode 6 corresponding to the image erasing region of the electron ray generating unit 2 is driven and an electron ray is applied to the storage plate 4. The potential of that portion of the storage plate 4 in which an image has been stored before the erasing mode is once raised to the order of 30 V as indicated by solid line in FIG. 4(*c*), but by the application of the electron beam, electrons are stored therein and the potential drops to 0 V which is substantially equal to the potential of the cold cathode. At this time, in the region where erasing is not effected, 30 V is maintained as indicated by broken line. Also, the potential of the dielectric layer of the portion in which no image has been stored before the erasing mode is approximately 0 V during the erasing mode, and this is maintained irrespective of the presence or absence of the drive of the cold cathode, as shown in FIG. 4(*d*).

Next, during the writing mode, a voltage of the order of 500 V is applied to the metal mesh of the storage plate 4 and at the same time, a slightly higher voltage of the order of 520 V is applied to the collector electrode 3. Along therewith, the potential of the dielectric layer of the region of the storage plate 4 in which an image is stored is raised to the order of 500 V as indicated by broken line in FIG. 4(*c*), and this is maintained during the writing mode. On the other hand, the potential of the dielectric layer of the region in which no image is stored is raised to the order of 470 V, but when writing is not effected, this potential is maintained as shown in FIG. 4(*d*).

Also, when writing is effected, the cold cathode is driven correspondingly to the writing data, and an electron ray is applied to the writing region. In the aforedescribed erasing mode, the acceleration voltage applied to the electrically conductive metal of the storage plate 4 is low and therefore, the secondary electron emission ratio of the dielectric material has been less than 1, but in the writing mode, the acceleration voltage is high and therefore, the secondary electron emission ratio exceeds 1. Accordingly, the dielectric material of the region to which the electron ray is applied is gradually charged positively by the secondary electron emission and the potential thereof rises until it is saturated, as indicated by solid line in FIG. 4(*c*), and at the same time, the emitted secondary electrons are caught by the collector electrode 3. As a result, the region into which an image has been written has a potential of the order of 500 V, and the region into which no image has been written has a potential of the order of 470 V.

Next, in the display mode, an acceleration voltage is applied to the target 5 to impart to electrons sufficient energy to excite the fluorescent material and emit a visible light. When the potential of the electrically conductive metal of the storage plate 4 is lowered to the order of 10 V substantially simultaneously therewith, the potential of the aforementioned dielectric material into which the image has been written becomes about 10 V, and the potential of the dielectric material into which no image has been written becomes about −20 V. So, all the cold cathodes 6 of the electron ray generating unit are driven to emit electrons, whereupon the storage plate 4 acts just like a control grid to control the electron ray.

That is, in the region of +10 V, electrons easily pass through the metal mesh of the storage plate 4 to the target, but in the region of −20 V, electrons do not reach the storage plate 4 due to the repulsion force and thus, do not irradiate the target.

In FIG. 4, for the convenience of illustration, the operation times for the respective modes are shown to be equal, but actually, the respective times may differ. Also, the operating potential is not limited to the above-described embodiment.

The operations of the respective portions have been described above with respect to the three modes, i.e., erasing, writing and displaying, and here, the driving of the electron ray generating unit 2 will be further described supplementally. As schematically shown in FIG. 2, the minute cold cathodes used in the display device of the present invention can be selectively driven by a suitable voltage being applied to an X electrode and a Y electrode. For example, if one X electrode and one Y electrode are successively selected, point-successive driving will be effected. Also, as is readily analogized, point-successive driving, driving of units in a block or simultaneous driving of all the cold cathodes is possible.

Paying attention to such a characteristic, in the display device of the present invention, where the region to be erased is a rectangle having sides parallel to the XY coordinates axis, a plurality of X electrodes and Y electrodes are selected at a time, whereby application of an electron ray is effected to the whole surface of the region to be erased at a time, and where the region to be erased is of a shape other than a rectangle, row-successive drive is effected. Consequently, the time required for the erasing operation can be remarkably shortened, but where the high speed of erasing is not so important, erasing by the point-successive or row-successive driving may be effected.

This also holds true in the writing mode, and even the point-successive driving provides no hindrance in principle, but in the present embodiment, the row-successive driving in effected at a higher speed.

Further, in the displaying mode, the point-successive or row-successive driving may be adopted, but in the display device of the present embodiment, all the cold cathodes are driven at a time to reduce the flickering of the image and a reduction in the brightness of the image.

Another storage-type image display device according to the present invention is characterized by the provision of an electron ray generating unit of a matrix electrode structure comprising at least two kinds of cold cathodes different in their electron ray emission characteristic and arranged two-dimensionally, image storing means for storing or erasing image information as an amount of charges by a variation in the surface potential caused by the application of an electron ray from a first cold cathode group of he electron ray generating unit, and visualizing means subjected to the application of an electron ray applied from a second cold cathode group of the electron ray generating unit and modulated by the charges retained by the image storing means and thereby visualizing the image information. That is, the cold cathodes designated by the numeral 6 in FIG. 2 are formed by at least two kinds of cold cathodes differing in their electron ray emission characteristic.

The basic construction of another storage-type image display device according to the present invention is also as shown in FIG. 1. The electron ray generating unit 2 comprises a plurality of minute cold cathodes of a solid electron beam generating apparatus disposed on the same substrate, and as schematically shown in FIG. 6, the cold cathodes are divided into first cold cathodes 101 and second cold cathodes 102.

In the above-described display device, when an electron ray is applied from the first cold cathode ray of the electron ray generating unit, the image information is stored as charges in the image storing means, and when an electron ray is applied to the stored charges from the second cold cathode group of the electron ray generating unit, electrons pass through the portion charged positively, and in the other portions, electrons are intercepted by the repulsion force. The electrons having passed through the image storing means in this manner are displayed as images by the visualizing means. If the electron ray emission characteristic of the second cold cathode group used for displaying is set to a great value as compared with the first cold cathode group, the brightness of the displayed images can be enhanced.

Of course, this display device having the first and second cold cathodes are also such that each minute cold cathode is of a matrix electrode structure and therefore can be independently driven and thus, partial rewriting becomes possible.

Figure 6:
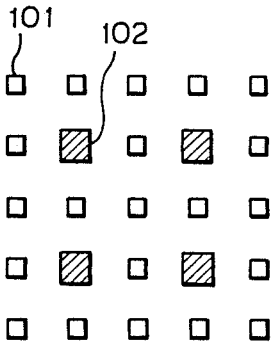
FIG. 6 schematically shows the arrangement of cold cathodes used in the present invention.
Figure 7A:
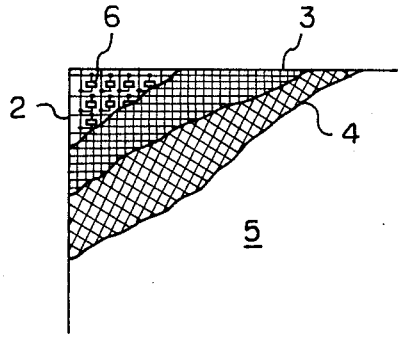
FIG. 7A is a partly cut-away view of a display device according to the present invention.
Figure 7B:
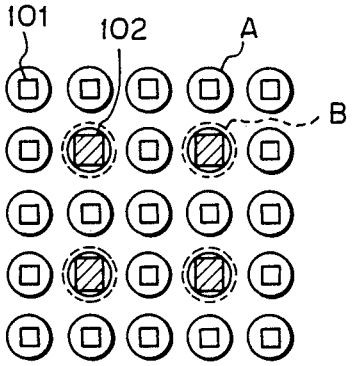
FIG. 7B schematically shows the positional relation between cold cathodes and holes.

In FIG. 6, each of the first cold cathodes 101 is relatively small in the area of the electron ray emitting portion and has the characteristic of emitting an electron ray having a small cross-sectional area. On the other hand, each of the second cold cathodes 102 is relatively large in the area of the electron ray emitting portion and has the characteristic of emitting an electron ray having a large cross-sectional area. The second cold cathodes 102 are arranged at intervals substantially equal to the picture element pitch of the displayed image. In the present invention, the first cold cathode group is used for writing and erasing the stored images and the second cold cathode group is used for displaying the images. The collector electrode 3, as previously described, for catching secondary electrons and providing a return path, and may be for example, a plate-like electrode formed of nickel. This collector electrode is provided with holes for passing the electron ray therethrough at positions opposed to the first and second cold cathode groups of the electron ray generating unit. The storage plate 4 may be an electrically conductive metal plate of nickel or the like provided with holes at positions opposed to the second cold cathode group of the electron ray generating unit 2 and having a thin film of a dielectric secondary electron emitting material (magnesium fluoride, or magnesium oxide formed on calcium fluoride) of the order of 1–5 μm produced on the surface thereof by the use of the vacuum producing technique. The target 5 may be a transparent glass substrate having fine particles of a fluorescent material applied thereto and an electrically conductive thin film of a metal formed thereon by vapor deposition. FIG. 7A is a partly cut-away view of the display device according to the present invention as seen from the target 5 side. As shown in FIG. 7A, minute cold cathodes 6 are connected together by an X-Y matrix electrode structure and can be driven individually or at a time. FIG. 7B schematically shows the positional relations between the respective cold cathode groups and the holes provided in the collector electrode and storage plate. In FIG. 7B, the holes A indicated by solid line are the holes provided in the collector electrode 3, and the holes B indicated by broken line are the holes provided in the storage plate 4.

A description will now be provided of the operation of the display device of the above-described construction.

Basically, the modes for the display device in which all the aforementioned cold cathodes are of the same kind are applied. In this case, however, the first cold cathode group is used for writing and erasing the stored images and the second cold cathode group is used for displaying the stored image and therefore, the following actuation modes are adopted.

The operation for each mode will hereinafter be described with reference to FIG. 4.

First, in the erasing mode, a voltage of the order of 30 V relative to the potential of the first cold cathodes 101 of the electron ray generating unit is applied to the electrically conductive metal plate which is the substrate of the storage plate 4. Substantially simultaneously therewith, the first cold cathode 101 of the electron ray generating unit 2 which corresponds to the image-erased region is driven, and an electron ray is applied to the storage plate 4. In the storage plate 4, the potential of the dielectric layer of the portion in which images were stored before the erasing mode is once raised to the order of 30 V as indicated by solid line in FIG. 4(*c*), but by the application of the electron beam, electrons are stored therein and the potential of the diselectric layer drops to 0 V substantially equal to the potential of the cold cathode. At this time, in the region wherein erasing is not effected, 30 V is maintained as indicated by broken line. Also, the potential of the dielectric layer of the portion in which images were not stored before the erasing mode is approximately 0 V during the erasing mode, and this is maintained irrespective of the presence or absence of the driving of the cold cathodes, as shown in FIG. 4(*d*).

Next, during the writing mode, a voltage of the order of 500 V is applied to the electrically conductive metal of the storage plate 4 and at the same time, a slightly higher voltage of the order of 520 V is applied to the collector electrode 3. Along therewith, the potential of the dielectric layer of the region on the storage plate 4 in which images are stored is raised to the order of 500 V as indicated by broken line in FIG. 4(*c*), and this is maintained during the writing mode. On the other hand, the potential of the dielectric layer of the region which images are not stored is raised to the order of 470 V, but this voltage is maintained as indicated in FIG. 4(*d*) when writing is not effected.

Also, when writing is effected, the first cold cathodes 101 are driven correspondingly to the writing data and an electron ray is applied to the writing region. In the erasing mode, the acceleration voltage applied to the electrically conductive metal of the storage plate 4 is low and therefore, the secondary electron emission ratio of the dielectric material has been smaller than 1, but in the writing mode, the acceleration voltage is high and therefore, the secondary electron emission ratio exceeds 1. Accordingly, the dielectric material of the region to which the electron ray is applied is gradually charged to the positive by the secondary electron emission and, as indicated by solid line in FIG. 4(*c*), the potential thereof rises until saturated and at the same time, the emitted secondary electrons are caught by the collector electrode 3. As a result, the region in which images are written has a potential of the order of 500 V and the region in which images are not written has a potential of the order of 470 V.

Next, in the displaying mode, an acceleration voltage is applied to the target 5 to give the electrons sufficient energy to excite the fluorescent material so as to emit a visible light. Substantially simultaneously therewith, the potential of the electrically conductive metal plate of the storage plate 4 is reduced to the order of 10 V, whereupon the potential of the aforementioned dielectric material in which images are written becomes about 10 V and the potential of the dielectric material in which images are not written becomes about −20 V.

When all the second cold cathodes of the electron ray generating unit 2 are driven to cause them to emit electrons, the storage plate 4 acts to control the electron ray as if it were a control grid.

That is, in the region of +10 V, electrons easily pass through the holes provided in the storage plate 4 to the target, but in the region of −20 V, electrons do not arrive at the storage plate 4 due to the repulsion force and thus, do not irradiate the target.

In FIG. 4, for the convenience of illustration, the operating times for the respective modes are shown to be equal, but actually, the respective times may differ. Also, the operating potential is not limited to the abovedescribed embodiment.

The cold cathodes used in the present invention are not restricted to the aforedescribed solid electron beam generating apparatus if there are a number of cold cathodes arranged at a minute pitch on the same substrate and capable of forming at least two kinds of generating sources differing in their electron emission characteristic with good representability. Also, in the previously described embodiment, cold cathodes which are small in the area of the electron ray emitting portion and cold cathodes which are relatively large in the area of the electron ray emitting portion are used as the two kinds of cold cathodes. However, the combination of plural kinds of cold cathodes usable in the present invention is not limited to this example. That is, if the cold cathodes differ in their electron ray emission characteristic, not only such cold cathodes may differ in area and shape at the electron ray emitting portion, but also they may differ in their emission characteristic or in the structure itself of the cold cathodes by changing the kinds and concentrations of impurities, for example, by the use of the semiconductor process.

The arrangement of the two kinds of cold cathodes is not limited to the example shown in FIG. 6, but may be changed in accordance with the desired resolution of the displayed image or the secondary electron emission characteristic of the storage plate. In that case, of course, the arrangement of the holes in the collector electrode and storage plate must be changed in accordance with the arrangement of the cold cathodes.

Another object of the present invention is a display device in which at least two kinds of pulural cold cathodes differing in their electron ray emission characteristic are arranged two-dimensionally and which has the features of an electron ray generating apparatus characterized in that the arrangement of driving signal lines for driving the cold cathodes is of a matrix electrode structure by a first electrode group and a second electrode group orthogonal to each other. The first electrode group is connected in common with respect to all the cold cathodes on the same line irrespective of the kind of the cold cathodes, and the second electrode group is connected in common with respect to the same kind of cold cathodes.

As described above, a solid electron beam generating device is used as the cold cathodes forming the electron ray generating apparatus, whereby the problem peculiar to the conventional hot cathodes can be solved. Further, in the present invention, one terminal of each cold cathode is connected in common by one line and the other terminal is connected in common for each same kind by one line and therefore, the driving of each cold cathode may be effected by a driving circuit having a single function matching the cold cathode, and does not require a complex driving circuit for satisfying the characteristics of both as in the prior art, or a driving circuit for distributing each data signal in accordance with the arrangement of the cold cathodes.

Figure 8:
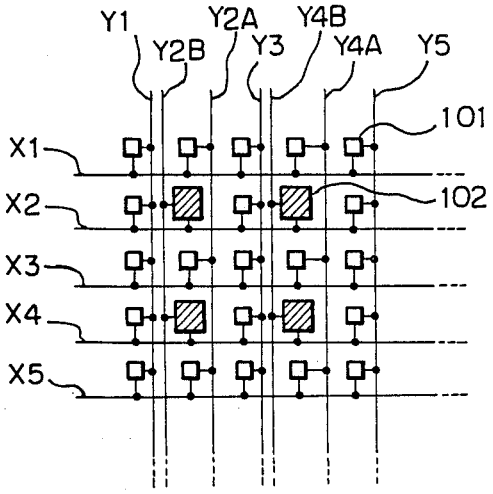
FIG. 8 to 10 show an embodiment of the present invention.

FIG. 8 schematically shows a portion of the electron ray generating apparatus used as the electron ray generating unit of a storage type image display tube.

The electron ray generating apparatus comprises a plurality of minute cold cathodes comprising the solid electron beam generating apparatus and arranged on the same substrate, and in the present embodiment, two kinds of cold cathodes differing in their emission characteristic are arranged. In FIG. 8, first cold cathodes 101 are relatively small in the area of the electron ray emitting portion and have the characteristics of emitting an electron ray of a small cross-sectional area, and second cold cathodes 102 are relatively large in the area of the electron ray emitting portion and have the characteristic of emitting an electron ray of a large cross-sectional area. In the present embodiment, the first cold cathode group is used for writing and erasing the stored images, and the second cold cathode group is used for displaying the images. The driving signal line for driving each cold cathode comprises first electrode groups Xl–X5 and second electrode groups Yl–Y5 formed in a matrix-like shape. The most characteristic portion in the present invention is the connecting portions between the electrodes formed in the matrix-like shape and the cold cathodes. That is, with regard to the first electrode groups Xl–X5, both the first cold cathodes 101 and the second cold cathodes 102 are connected in common, and with regard to the second electrode groups Yl–Y5, the cold cathodes of the same kind are connected together in common on each line. By such wiring, the drive control of the two kinds of cold cathodes becomes easy.

For example, a high-speed driving signal (during the image writing operation) needs to be applied to the first cold cathodes and a low-speed but relatively high voltage driving signal (during the displaying operation) needs to be applied to the second cold cathodes. However, if the cold cathodes were connected in common by a simple matrix, the driving circuit has to be complicated to satisfy the two requirements of the aforementioned high speed and high voltage. In contrast, in the present invention, a low-voltage and high-speed driving element may be used for the electrodes Yl, Y2A, Y3, Y4A and Y5 and a low-speed but high-voltage driving element may be used for the electrodes Y2B and Y4B, and this leads to great ease of designing and manufacturing of the driving circuit.

Figure 9:
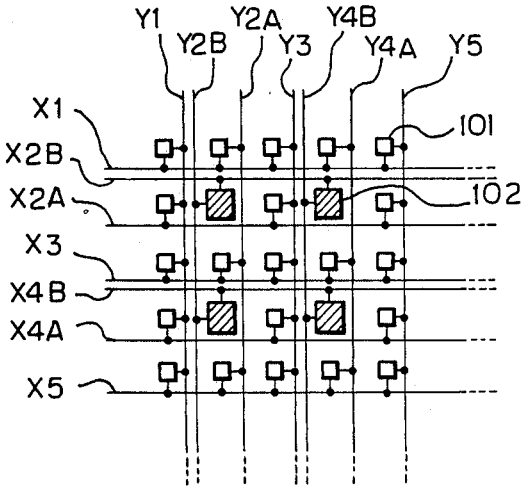

FIG. 9 shows another embodiment of the present invention. In this embodiment, both of first electrode groups Xl, X2B, . . . , X5 and second electrode groups Yl, Y2B, . . . , Y5 are such that only cold cathodes of the same kind are connected in common. By such wiring, two kinds of cold cathodes are electrically insulated from each other and can be biased by different potentials and moreover, can be driven independently of each other. Accordingly, even if the cold cathodes used differ in principle and structure, if they can be formed on the same substrate, they can be easily driven irrespective of the characteristics thereof.

Figure 10:
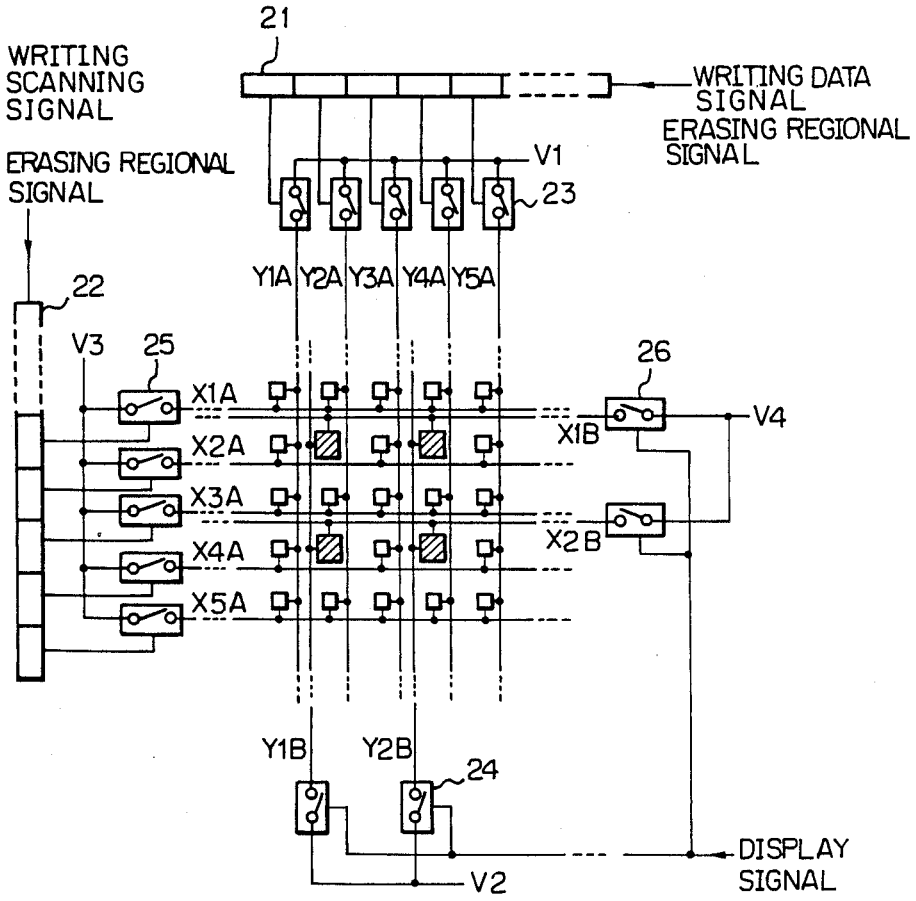
Figure 11A:
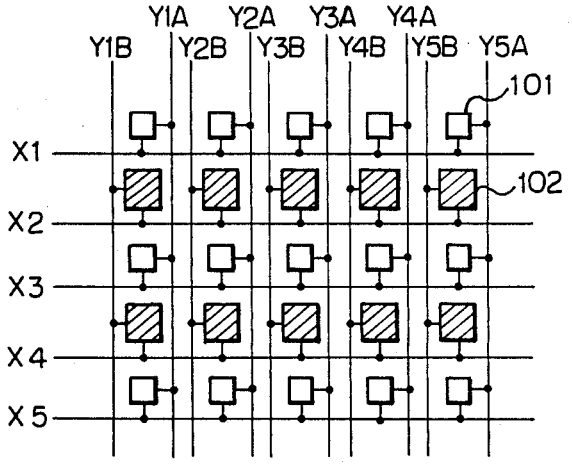
FIG. 11A and 11B show two examples of the arrangement of cold cathodes.
Figure 11B:
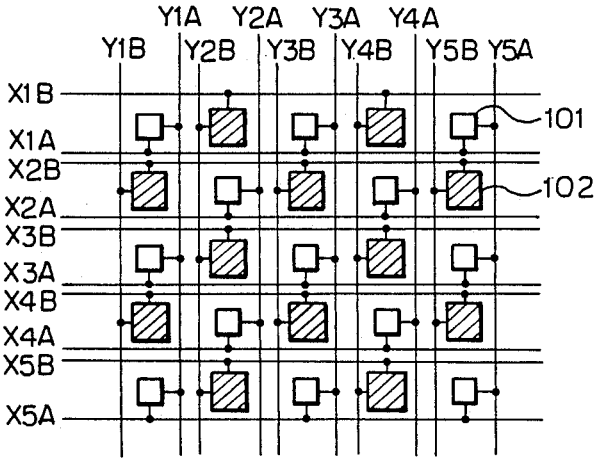

FIG. 10 shows a specific circuit in the electron ray generating apparatus shown in FIG. 9.

In FIG. 10, reference numeral 21 designates a shift register for serial/parallel converting a writing data signal or an erasing regional signal supplied time-serially, and reference numeral 23 denotes switching elements for applying a voltage Vl to one terminal of each of the first cold cathodes 101 on the basis of a signal supplied from the shift register 21. Reference numeral 22 designates a shift register for serial/parallel converting a writing scanning signal or an erasing regional signal supplied time-serially, and reference numeral 25 denotes switching elements for applying a voltage V3 to the other terminal of each of the first cold cathodes 101. Reference numerals 24 and 26 designate switching elements for supplying voltages V2 and V4 to drive the second cold cathodes 102 when the stored images are to be displayed.

The two kinds of cold cathodes used in the present embodiment are driven respectively by entirely different voltages, and if the potential of the substrate is 0 V, the first cold cathodes 101 emit electron rays when voltages Vl and V3 are applied thereacross at a time, and the second cold cathodes 102 emit electron rays when voltages V4 and V2 are applied threreacross at a time.

The function of a storage type image display tube will now be discribed briefly. In the erasing mode, the switching elements 23 and 25 corresponding to the erasing regions are driven and electron rays are emitted from the first cold cathodes 101. For example, in the case of the entire erasing, all of the switching elements 23 and 25 may be driven simultaneously, and in the case of the partial erasing, only the erasing regions may be selectively driven. In the writing mode, data corresponding to one line of the image can be stored in the shift register 21 and therefore, line-successive driving for each line is effected. That is, the voltage V3 is applied to the electrodes XlA, X2A, . . . in succession for one line each and the line scanning is effected. In the displaying mode, the switching elements 24 and 26 are driven simultaneously and displaying electron beams are emitted from all the second cold cathodes 102.

In the foregoing, for the convenience, a description has provided of made with the arrangement of the cold cathodes restricted to the illustrated example, whereas the arrangement of the cold cathodes in the present invention is not limited to such an example, but may be an arrangement as shown in FIG. llA in which two kinds of cold cathodes are arranged every other row, or an arrangement as shown in FIG. llB in which two kinds of cold cathodes are alternately arranged in each row.

Also, the cold cathodes arranged on the same substrate are not limited to two kinds, but as the number of kinds is greater, the effect of the present invention is greater.

Furthermore, the cold cathodes of different kinds may be cold cathodes which differ in their electron ray emission characteristic and can be arranged on the same substrate, and may be cold cathodes entirely different in structure and principle of operation, such as cold cathodes changed in their emission characteristic by changing the materials and concentrations thereof, cold cathodes changed in the area and shape of the electron ray emitting portions thereof, or cold cathodes having a difference in the deflecting electrodes (Japanese Patent Publication No. 30274/1979) formed on a substrate.

As described above, in the storage-type image display device according to the present invention, any complicated electronic optical system is not required and thus, the device can be made thin. Also, without employing a writing gun and a flood gun heretofore discretely disposed, the cold cathodes formed and arranged on the substrate are used as electron sources. As a result, the assembling process can be simplified and the manufacturing cost can be greatly reduced as compared with the conventional type.

Further, in the display device of the present invention, partial erasing can be accomplished and therefore, the display device of the present invention can be made very useful in practice.

Also, the use of two kinds of cold cathodes as electron sources leads to the simplification of the assembling process in the manufacture, which in turn leads to a great reduction in the manufacturing cost as compared with the conventional type of display apparatus.

By contriving the arrangement of the holes provided in the collector electrode and storage plate, the problem of the deterioration of stored images by the charge-up of the storage plate which has occurred to the conventional type can be eliminated. That is, in the displaying mode, the displaying electron rays travel toward the holes in the storage plate and therefore do not collide against the dielectric material on the storage plate. As a result, as compared with the prior art in which use is made of a flood gun of the type which uniformly applies an electron ray, it has become possible to greatly extend the stored image retaining time. Further, cold cathodes great in the amount of taken-out current are used as the displaying cold cathodes, whereby sufficient brightness can be obtained on the display screen.

As described above, according to the present invention, there can be provided an electron ray generating apparatus which is low in power consumption and quick in response, and a greater capacity and higher speed apparatus can be easily achieved. Further, according to the present invention, the drive control of the electron ray generating unit comprising different kinds of cold cathodes arranged on the same substrate becomes very easy to obtain and thus, the surrounding circuit can be simplified. Also, the present invention is applicable not only to the storage type image display tube shown in the previously described embodiment, buy also to a wide field, and is very effective, for example, in image recording using an electron ray as well as a device such as a memory or lithography.

What is claimed is:

1. A storage-type image display device, comprising:

a plurality of cold cathodes provided on a surface side of a substrate, said cold cathodes comprising a plurality of first cold cathodes and a plurality of second cold cathodes;

image display means disposed proximate to said cold cathodes and having a space therebetween; and a storage plate having a plurality of holes therein being disposed between said cold cathodes and said image display and having a space on either side thereof, wherein said plurality of first cold cathodes emits electron rays impinging on said storage plate, and said plurality of second cathodes emits electron rays impinging on a surface of said image display means, and said storage plate having a plurality of holes being arranged so that the electron rays emitted from said second cathodes may pass through the holes, and wherein said plurality of first and second cold cathodes are arranged two-dimensionally and further comprising a driving signal line for driving said plurality of first and second cold cathodes, said driving signal line having a matrix electrode structure comprising a first electrode group and a second electrode group disposed orthogonal to said first electrode group, wherein said first electrode group connects first and second cold cathodes, and wherein said second electrode group connects only cold cathodes of one of said plurality of first cold cathodes and said plurality of second cathodes.

2. A storage-type image display device according to claim 1, further comprising a collector electrode disposed between said storage plate and said plurality of cold cathodes and having a space on either side thereof, said collector electrode having a plurality of holes therein which are arranged so that the electron rays emitted from said first and second cold cathodes may pass through the holes.

3. A storage-type image display device according to claim 1, wherein said first and second cold cathodes are arranged on the same substrate.

4. A storage-type image display device according to claim 1, wherein said first and second cold cathodes are arranged in every other row.

5. A storage-type image display device according to claim 1, wherein said first and second cold cathodes are alternately arranged in each row.

6. A storage-type image display device, comprising:

a plurality of cold cathodes provided on a surface side of a substrate, said cold cathodes comprising a plurality of first cold cathodes and a plurality of second cold cathodes;

image display means disposed proximate to said cold cathodes and having a space therebetween; and a storage plate having a plurality of holes therein being disposed between said cold cathodes and said image display and having a space on either side thereof, wherein said plurality of first cold cathodes emits electron rays impinging on said storage plate, and said plurality of second cathodes emit electron rays impinging on a surface of said image display means, and said storage plate having a plurality of holes being arranged so that the electron rays emitted from said second cathodes may pass through the holes, and wherein said plurality of first and second cold cathodes are arranged two-dimensionally and further comprising a driving signal line for driving said plurality of first and second cold cathodes, said driving signal line having a matrix electrode structure comprising a first electrode group and a second electrode group orthogonal to said first electrode group, wherein said first electrode group connects only cold cathodes of one of said plurality of first cold cathodes and said plurality of second cold cathodes and wherein said second electrode group connects only cold cathodes of one of said plurality of first cold cathodes and said plurality of second cathodes.

7. A storage-type image display device according to claim 6, further comprising a collector electrode disposed between said storage plate and said plurality of cold cathodes and having a space on either side thereof, said collector electrode having a plurality of holes therein which are arranged so that the electron rays emitted from said first and second cold cathodes may pass through the holes.

8. A storage-type image display device according to claim 6, wherein said first and second cold cathodes are arranged on the same substrate.

9. A storage-type image display device according to claim 6, wherein said first and second cold cathodes are arranged in every other row.

10. A storage-type image display device according to claim 6, wherein said first and second cold cathodes are alternately arranged in each row.

* * * * *